US008730767B2

(12) United States Patent
Balmer et al.

(10) Patent No.: US 8,730,767 B2
(45) Date of Patent: May 20, 2014

(54) LARGE APERTURE DISPLAY FOR A TIMEPIECE

(75) Inventors: Raphael Balmer, Courrendlin (CH); Stephane Claude, Grenchen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 426 days.

(21) Appl. No.: 13/228,781

(22) Filed: Sep. 9, 2011

(65) Prior Publication Data

US 2012/0075961 A1 Mar. 29, 2012

(30) Foreign Application Priority Data

Sep. 27, 2010 (EP) ..... 10180128

(51) Int. Cl.

| | |
|---|---|
| ***G04B 19/20*** | (2006.01) |
| ***G04F 8/00*** | (2006.01) |
| ***G04B 19/02*** | (2006.01) |
| ***G04B 19/247*** | (2006.01) |
| ***G04C 3/14*** | (2006.01) |
| ***G04C 17/00*** | (2006.01) |

(52) U.S. Cl.

CPC ..... *G04B 19/247* (2013.01); *G04C 3/146* (2013.01); *G04C 17/0066* (2013.01); *G04F 8/006* (2013.01)

USPC ..... 368/37; 368/110; 368/221

(58) Field of Classification Search

USPC ..... 368/35, 37, 77, 101, 110, 113, 221, 233

See application file for complete search history.

(56) References Cited

U.S. PATENT DOCUMENTS

| | | | | |
|---|---|---|---|---|
| 5,359,578 | A * | 10/1994 | Truini | 368/76 |
| 5,999,496 | A * | 12/1999 | Chaut | 368/223 |
| 7,061,833 | B2 * | 6/2006 | Dierenbach | 368/76 |
| 2005/0111303 | A1 | 5/2005 | Willemin et al. | |
| 2005/0152225 | A1 | 7/2005 | Dias | |
| 2005/0174891 | A1 * | 8/2005 | Besse | 368/37 |
| 2006/0133214 | A1 * | 6/2006 | Suzuki | 368/37 |
| 2007/0047390 | A1 * | 3/2007 | Suzuki | 368/37 |
| 2007/0177464 | A1 * | 8/2007 | Watanabe | 368/37 |

FOREIGN PATENT DOCUMENTS

| | | | |
|---|---|---|---|
| EP | 1184751 | A1 | 3/2002 |
| EP | 1406131 | A1 | 4/2004 |
| EP | 1536299 | A1 | 6/2005 |
| EP | 2161631 | A2 | 3/2010 |

OTHER PUBLICATIONS

European Search Report cited in EP 10180128, dated Feb. 14, 2011.

* cited by examiner

*Primary Examiner* — Vit W Miska

(74) *Attorney, Agent, or Firm* — Sughrue Mion, PLLC

(57) ABSTRACT

The timepiece includes first (1) and second (2) rings to which indications (3, 4) are affixed for displaying, in combination with each other, a time-related magnitude (5), which appears in a large aperture (6). The rings (1, 2) have equal dimensions, are arranged one on top of the other and off-center in relation to each other such that, at the vertical of the large aperture, the outer edge (7) of the first ring (1) substantially borders the inner edge (8) of the second ring (2).

7 Claims, 4 Drawing Sheets

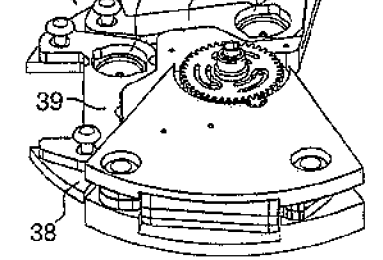
Fig. 4
Fig. 5
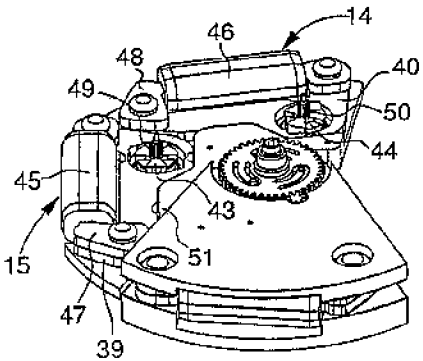
Fig. 6
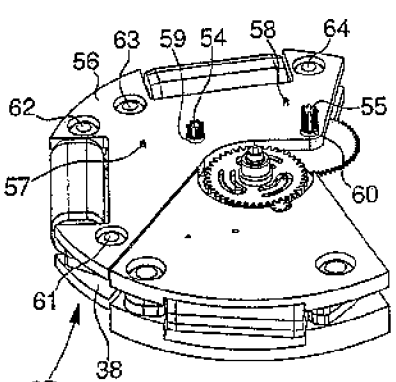
Fig. 7
Fig. 8
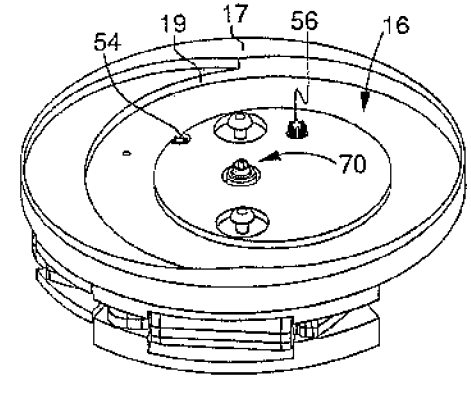
Fig. 9

LARGE APERTURE DISPLAY FOR A TIMEPIECE

This application claims priority from European Patent Application No. 10180128.0 filed Sep. 27, 2010, the entire disclosure of which is incorporated herein by reference.

The present invention relates to a timepiece including at least first and second rings, to which are respectively affixed first and second indications, arranged to display in combination with each other a time-related magnitude which appears in a large aperture.

In most cases, timepieces displaying the day of the month are fitted with a single disc or ring with the numerals from 0 to 31 affixed to the periphery thereof. These numerals appear in an aperture made in the timepiece dial. Consequently, the date indications are naturally of small dimensions and relatively difficult to see. To improve this state of affairs and propose a clearly visible display of large dimensions, on the market, there are available timepieces fitted with a so-called large aperture date or display in which are visible a first indicator, to which the numerals of the tens of the date are affixed and a second indicator, to which the numerals of the units of said date are affixed.

A system of this type is disclosed in EP Patent No. 1 184 751 A1. In this document the indicators are rings of different dimensions, placed one inside the other and thus arranged concentrically relative to each other, with the indications appearing at the same level in the large aperture. The document also proposes displaying the day of the month or the two last numerals of the year by means of these indicators. The display of the last two numerals of the year presupposes the use of two rings, to each of which are affixed ten numerals from 0 to 9, since the value that appears in the large aperture can take a hundred distinct positions. In this case it will be clear that the size of the numerals affixed to the inner ring is smaller than the size that could be given to the numerals on the outer ring. For the sake of harmony the size of the numerals on the outer ring are then reduced to match the size of the numerals on the inner ring.

This situation results from the implementation of two rings arranged one inside the other, which leads to a reduction in the size of the numerals used. To overcome this drawback, in addition to complying with the generic definition given in the first paragraph of this description, the present invention is characterized in that said first and second rings have substantially equal dimensions, are arranged with the first ring on top of the second, and the first ring is off-centre relative to the second, such that at the vertical of the large aperture, the outer edge of the first ring substantially borders the inner edge of the second ring.

The features and advantages of the present invention will appear from the following description, given with reference to the annexed drawings, and providing, by way of explanatory, but non-limiting example, one advantageous embodiment of a large aperture display for a timepiece. In the drawings:

FIGS. 4 to 14 show the succession of steps for a possible embodiment of the invention;

Figure 1:
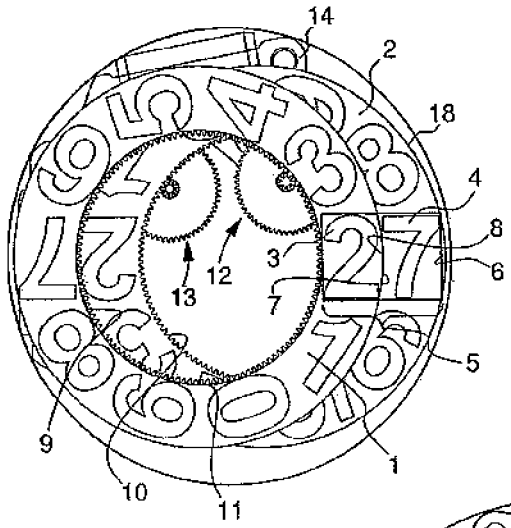
FIG. 1 is a simplified top view of the display of the invention showing the arrangement of the indicator rings.
Figure 2:
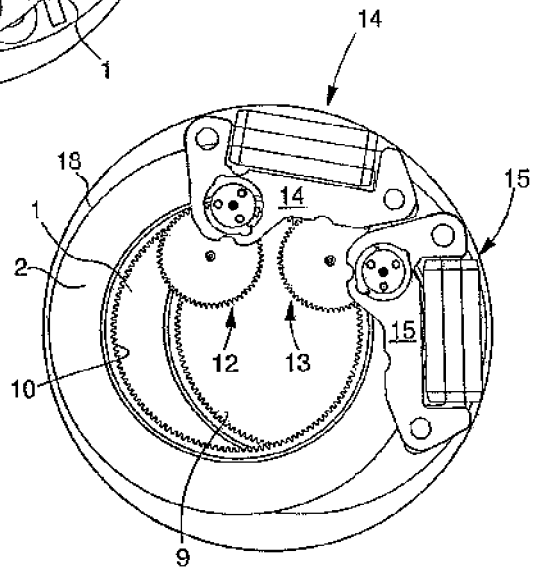
FIG. 2 is a bottom view of the display shown in FIG. 1.

As is clearly shown in FIG. 1, the timepiece of the invention includes at least first and second rings 1 and 2. The rings that are often called "discs" in the related literature, probably incorrectly, are flattened like a washer so as to carry respectively first and second indications 3 and 4. These indications are arranged to display in combination with each other a time-related magnitude 5 visible in a large aperture 6 made in a dial, which is not shown in the drawing.

Figure 3:
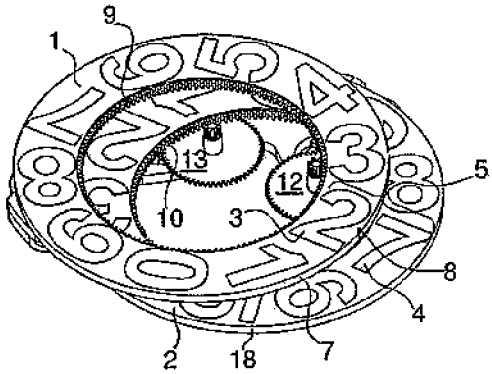
FIG. 3 is a perspective view of the display of FIG. 1.
Figure 12:
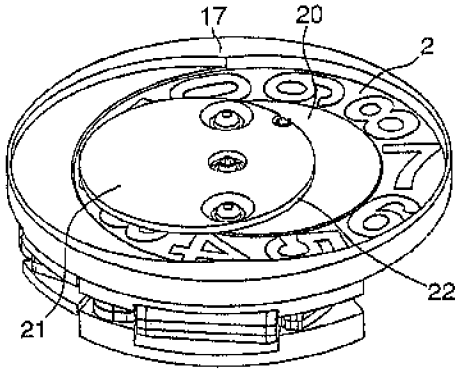

As regards the aforegoing statement which could describe the aforecited large aperture display of EP Patent No. 1 184 751 A1, the display of the present invention can be distinguished by several remarkable and original arrangements. First of all, it will be noted that the first and second rings 1 and 2 have substantially equal dimensions, so that only one ring has to be made which simplifies manufacture. Next, it is seen that the first ring 1 is arranged above the second ring 2. Finally, the first ring 1 is off-centre relative to second ring 2 such that, as clearly set out in FIGS. 1 and 3, at the vertical of the large aperture 6, the outer edge 7 of first ring 1 substantially borders the inner edge 8 of second ring 2.

Generally, the indications affixed to the rings are of a time-related nature although they are not necessarily Arabic numerals. For example, they could show the signs of the zodiac or Asian characters.

In a preferred case of the invention, ten Arabic numerals from 0 to 9, respectively 3 and 4, are affixed to each of the first and second rings 1 and 2. It is clear that the combination of these numerals allows a hundred distinct time-related magnitudes or a hundred positions to be displayed in large aperture 6.

If the aforecited embodiment is compared to that wherein the rings are arranged one inside the other and thus concentrically to each other, an approximately 15% increase in the size of the numerals is observed.

In an example embodiment, the height and width of the numeral were respectively measured to be 3.35 and 2.37 millimeters if the discs were made and arranged in accordance with the present invention, whereas the height and width are reduced to respectively 2.95 and 2.08 millimeters if the discs are arranged concentrically to each other. The advantage of placing the rings in accordance with the present invention is thus clear, since, with the same ultimate space requirement, the size of the numerals is considerably larger.

There are several possible ways of driving the rings. In the case taken by way of example here, the first and second rings 1 and 2 are driven in rotation respectively by first and second toothings 9 and 10 made on the inner edge 11 and 8 thereof. A kinematic chain, which is not shown here, may connect toothings 9 and 10 such that the first ring 1 moves forward one step every time that the second ring 2 has moved ten steps. Here, and as is shown in the Figures, the first and second toothings 9 and 10 are respectively meshed with first and second wheel sets 12 and 13, which mesh in turn and respectively with first and second motors 14 and 15.

The invention may be applied to any type of timepiece. However, its essential purpose is to display magnitudes that can take one hundred positions using two rings. This is the case, for example, of a current year display using the last two numerals of the year, or the tenth and hundredth of a second display of a chronograph.

We will take the example here of a chronograph watch in which the first and second rings will display either the tenth and hundredth of a second when the timepiece is operating in chronograph mode, or the day of the month or the current year when said timepiece is operating in watch mode. This example explains an example construction, wherein the off-centre position of the rings and driving thereof relies on an arrangement which is not immediately evident.

Figure 14:
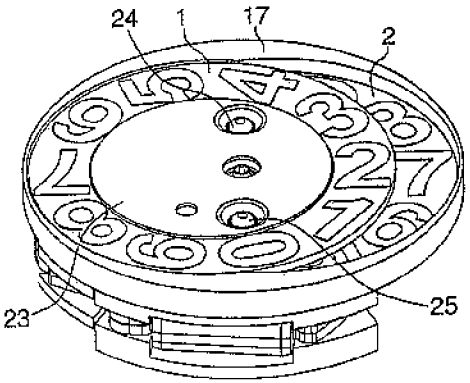
Figure 13:
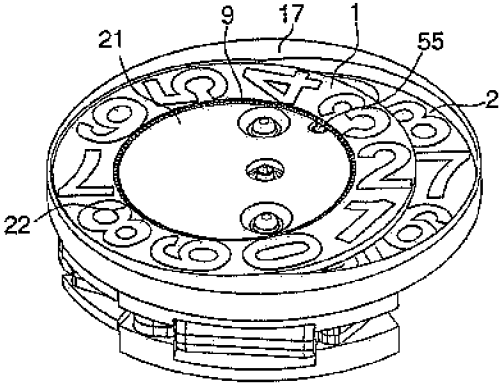
Figure 15:
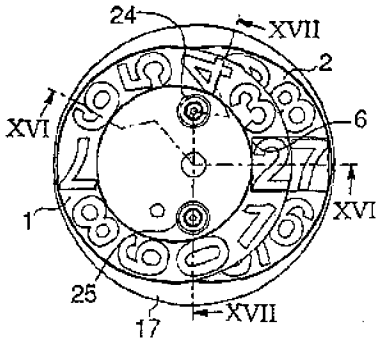
FIG. 15 is a top view of FIG. 14 showing the cross-sections along which FIGS. 16 and 17 have been taken.
Figure 16:
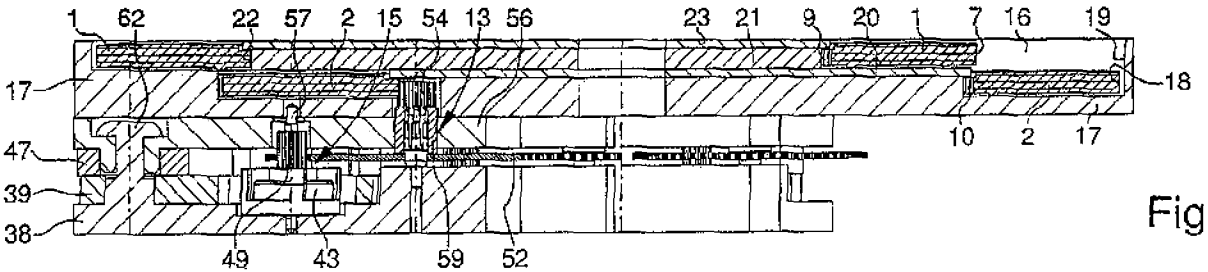
FIG. 16 is a cross-section along the line XVI-XVI of FIG. 15.
Figure 17:
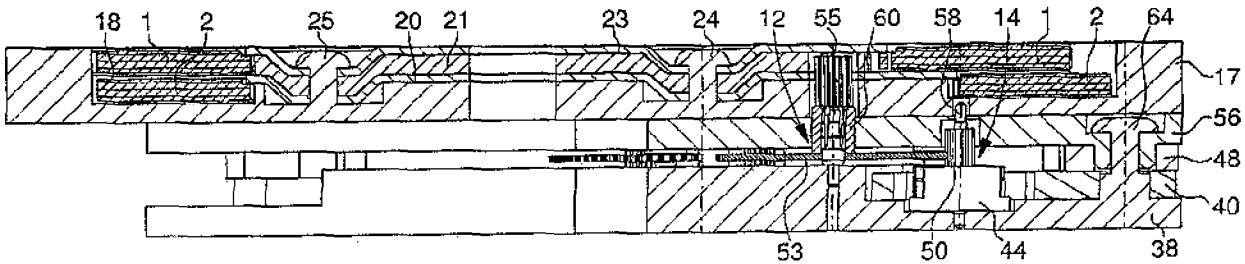
FIG. 17 is a cross-section along the line XVII-XVII of FIG. 15.

This example embodiment is shown in FIGS. 4 to 14 which show the series of steps implemented to construct the essential part of the chronograph watch, and in FIGS. 16 and 17 which are cross-sections respectively taken along the lines XVI-XVI and XVII-XVII of FIG. 15.

FIG. 4 shows the basic timepiece module from which there emerge, in a known manner, the pipe 30 of the hour wheel onto which the hour hand (not shown) is fitted, the cannon-pinion 31 onto which the minute hand (not shown) is fitted and the arbour 32 of the seconds wheel onto which the seconds hand (not shown) is fitted. These hands are driven here in a known manner by a motor 33 to form a first heat sealed unit 34 by studs 35 and 36. A second unit 37 is associated with this first unit 34, as seen in FIG. 5. This second unit 37 includes a base plate 38 on which two stators 39 and 40 rest, each pierced with an aperture 41 and 42 in each of which is housed a rotor 43 and 44 shown in FIG. 6. This FIG. 6 also shows that coils 45 and 46 are mounted on stators 39 and 40, each coil being fitted with a core 47 and 48 to form motors 15 and 14. FIG. 6 also shows that each rotor 43 and 44 is fitted with a pinion 49 and 50 and that a support 51 is arranged between units 34 and 37. Units 34 and 37 and support 51 are mounted on a bottom plate (not shown) of the timepiece.

Two wheel sets 13 and 12, each including a wheel 52 and 53 and a pinion 54 and 55, are mounted on support 51, as shown in FIG. 7. Wheel 52 is meshed with pinion 49 of motor 15 and wheel 53 is meshed with pinion 50 of motor 14. As seen in FIG. 8, a plate 56 is arranged on unit 37. This plate 56 acts as bearing for arbours 57 and 58 emerging from rotors 43 and 44 and for arbours 59 and 60 of wheel sets 13 and 12. Studs 61, 62, 63 and 64 derived from base plate 38 hold unit 37 by heat sealing.

Figure 10:
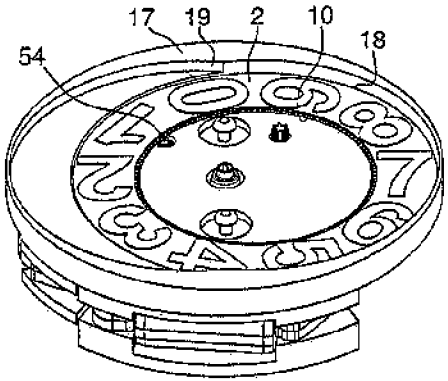

A bottom plate 17, arranged for receiving rings 1 and 2 disposed according to the present invention, is placed on the unit described above. As seen in FIG. 9, the aforementioned pinions 54 and 55 and unit 70 carrying the hour, minute and seconds hands emerge from bottom plate 17. The second ring 2 rests in a housing 16 shown in FIG. 9. This housing 16 has a circular periphery 19 acting as a guide for the outer edge 18 of second ring 2 and the second toothing 10 thereof is meshed with pinion 54 of motor 15, as shown in FIG. 10.

Figure 11:
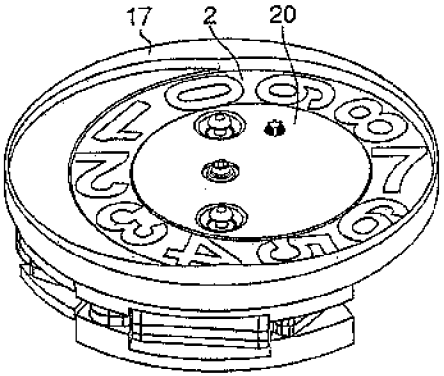

FIG. 11 shows that a first holding plate 20 rests on second toothing 10 of second ring 2 to retain said ring. A circular spacer 21 rests on the first holding plate 20 as illustrated in FIG. 1. The circular edge 22 of said spacer 21 acting as a guide for first ring 1 via first toothing 9 of first ring 1 is meshed with pinion 55 of motor 14. FIG. 14 shows that a second holding plate 23 rests on the first toothing 9 of first ring 1 to retain said ring. Finally, the same Figure shows that heat sealed rivets 24 and 25 secure the first and second holding plates 20 and 23 and strut 21 to plate 17 from which said rivets are derived.

While the embodiment that has just been described relies more particularly upon FIGS. 4 to 14, the cross-sections of FIGS. 16 and 17 taken along the plan view of FIG. 15 show the same embodiment and use the same components referenced by the same numerals.

The motors referred to in this description may be stepping motors controlled by an integrated circuit, controlled in turn by push-buttons and/or a crown fitted to the timepiece as described in the aforecited EP Patent No. 1 184 751 A1. In the drawings, the stepping motors are Lavet motors. Other types of motor could be envisaged, for example multipolar or piezo-electric motors.

What is claimed is:

1. A timepiece including at least first and second rings to which first and second indications are respectively affixed so as to display in combination with each other a time-related magnitude which appears in a large aperture made in a dial, characterized in that said first and second rings have substantially equal dimensions, are arranged with the first ring on top of the second and the first ring off-centre relative to the second, such that at the vertical of the large aperture, the outer edge of the first ring substantially borders the inner edge of the second ring.

2. The timepiece according to claim 1, characterized in that ten numerals from 0 to 9 are respectively affixed to each of the first and second rings, capable of displaying a hundred distinct time-related magnitudes in the large aperture.

3. The timepiece according to claim 2, characterized in that said first and second rings are associated with a chronograph watch for displaying respectively the tenth and hundredth of a second when the timepiece is operating in chronograph mode.

4. The timepiece according to claim 2, characterized in that the first and second rings are associated with a chronograph watch for displaying the day of the month when the timepiece is operating in watch mode.

5. The timepiece according to claim 1, characterized in that said first and second rings are driven in rotation respectively by first and second toothings made on the inner edge thereof.

6. The timepiece according to claim 1, characterized in that said first and second toothings are respectively meshed with first and second wheel sets, which mesh in turn and respectively with first and second motors.

7. The timepiece according to claim 1, characterized in that the second ring rests in a housing made in a plate forming part of said timepiece, said housing having a circular periphery acting as a guide for the outer edge of said second ring, in that a first holding plate rests on the second toothing of said second ring to retain said ring, in that a circular spacer rests on said first holding plate, the circular edge of said strut acting as a guide for the first ring via the first toothing thereof, in that a second holding plate rests on the first toothing of said first ring to retain said ring and in that said first and second holding plates and said spacer are secured to said plate by means of heat sealed rivets.

* * * * *